US007658281B2

(12) United States Patent
Eichenberger et al.

(10) Patent No.: US 7,658,281 B2
(45) Date of Patent: Feb. 9, 2010

(54) DEVICE FOR RECEIVING A COMMODITY IN A FIXED POSITION

(75) Inventors: Reinhard Eichenberger, Hergiswil (CH); Peter Gutjahr, Birkenfeld (DE)

(73) Assignee: Swatch AG, Biel (CH)

( * ) Notice: Subject to any disclaimer, the term of this patent is extended or adjusted under 35 U.S.C. 154(b) by 639 days.

(21) Appl. No.: 10/508,079

(22) PCT Filed: Feb. 20, 2003

(86) PCT No.: PCT/CH03/00128

§ 371 (c)(1),
(2), (4) Date: Sep. 16, 2004

(87) PCT Pub. No.: WO03/084839

PCT Pub. Date: Oct. 16, 2003

(65) Prior Publication Data

US 2005/0103673 A1 May 19, 2005

(30) Foreign Application Priority Data

Apr. 4, 2002 (CH) ..... 0570/02

(51) Int. Cl.
*B65D 81/07* (2006.01)
*B65D 81/05* (2006.01)

(52) U.S. Cl. ..... 206/301; 206/583; 206/477; 206/480

(58) Field of Classification Search ..... 206/301, 206/477–483, 592, 5, 6, 6.1, 583, 472; 220/628, 220/632

See application file for complete search history.

(56) References Cited

U.S. PATENT DOCUMENTS

| | | | | |
|---|---|---|---|---|
| 2,519,662 | A * | 8/1950 | Kempken | 206/317 |
| 2,681,142 | A | 6/1954 | Cohen | |
| 2,747,787 | A * | 5/1956 | Davidson, Jr. | 206/445 |
| 3,185,198 | A * | 5/1965 | Bryan | 383/6 |
| 3,780,487 | A * | 12/1973 | Munson | 53/472 |
| 4,093,068 | A * | 6/1978 | Smrt | 206/443 |

(Continued)

FOREIGN PATENT DOCUMENTS

DE 83 20 502 U 12/1983

(Continued)

OTHER PUBLICATIONS

International Search Report, completed Jun. 16, 2003.

*Primary Examiner*—Mickey Yu
*Assistant Examiner*—Steven A. Reynolds
(74) *Attorney, Agent, or Firm*—Griffin & Szipl, P.C.

(57) ABSTRACT

A container intended to receive a commodity, in particular a wristwatch or writing implement, includes a dish-shaped lower portion and a dish-shaped upper portion. A fastening element in the container is configured as a pair of clips including a resilient lower holding element arranged in the lower portion and a resilient upper holding element arranged in the upper portion. The two holding elements together form the pair of clips and interact so that they resiliently clamp between them the commodity located in the container when the upper portion is placed on the lower portion of the container. As a result, the commodity is perfectly fixed in position with the lowest structural expenditure substantially irrespective of its shape and dimensions.

17 Claims, 1 Drawing Sheet

U.S. PATENT DOCUMENTS

| | | | | | |
|---|---|---|---|---|---|
| 4,696,401 | A * | 9/1987 | Wallace | 206/594 |
| 4,903,827 | A * | 2/1990 | Phelps et al. | 206/204 |
| 5,218,510 | A * | 6/1993 | Bradford | 361/220 |
| 5,529,187 | A * | 6/1996 | DeNola | 206/449 |
| 5,641,068 | A * | 6/1997 | Warner | 206/523 |
| 5,988,387 | A * | 11/1999 | Staal et al. | 206/583 |
| 6,006,917 | A * | 12/1999 | Loeffler | 206/583 |
| 6,513,658 | B1 * | 2/2003 | Adkins | 206/522 |
| 6,547,200 | B2 * | 4/2003 | Dilworth | 248/316.5 |
| 6,629,616 | B1 * | 10/2003 | Heinzle | 211/85.7 |
| 6,964,339 | B2 * | 11/2005 | Meyer | 206/594 |
| 2003/0209463 | A1 * | 11/2003 | Halpin | 206/583 |

FOREIGN PATENT DOCUMENTS

| | | | |
|---|---|---|---|
| FR | 895 469 | A | 1/1945 |
| GB | 475 299 | A | 11/1937 |

* cited by examiner

Fig. 1
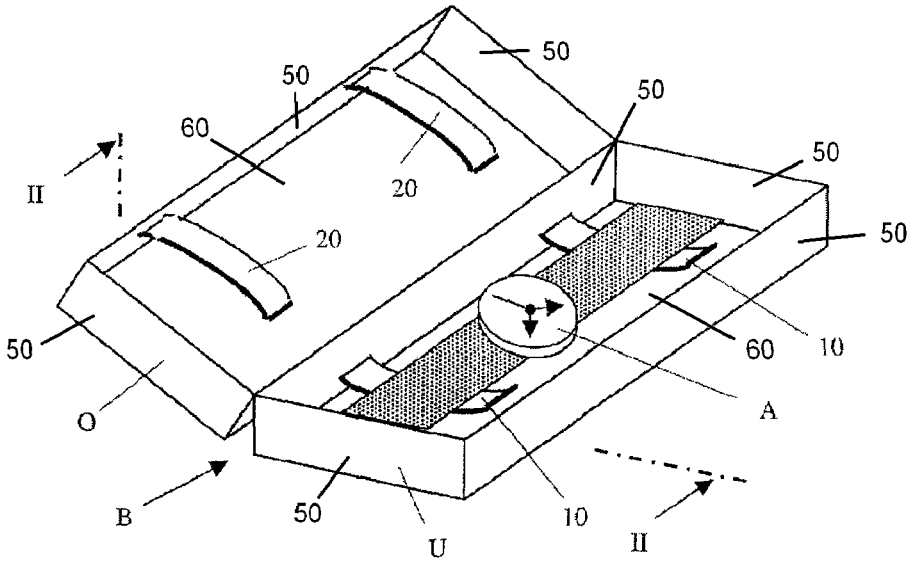
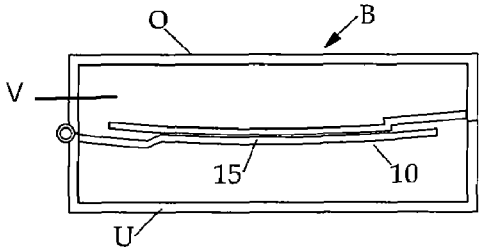
Fig. 2
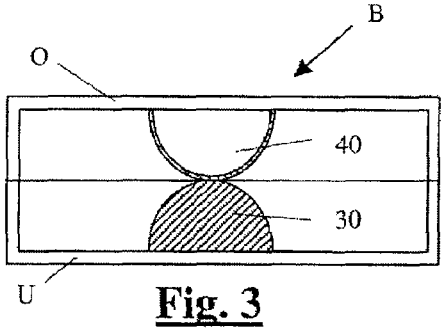
Fig. 3
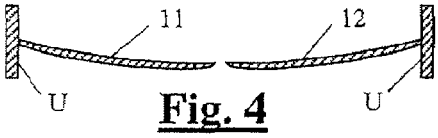
Fig. 4
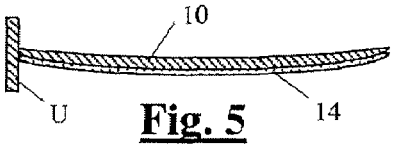
Fig. 5
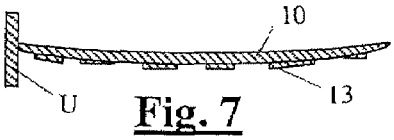
Fig. 7
Fig. 6
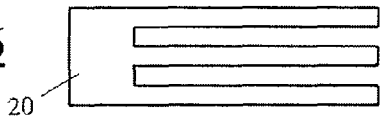
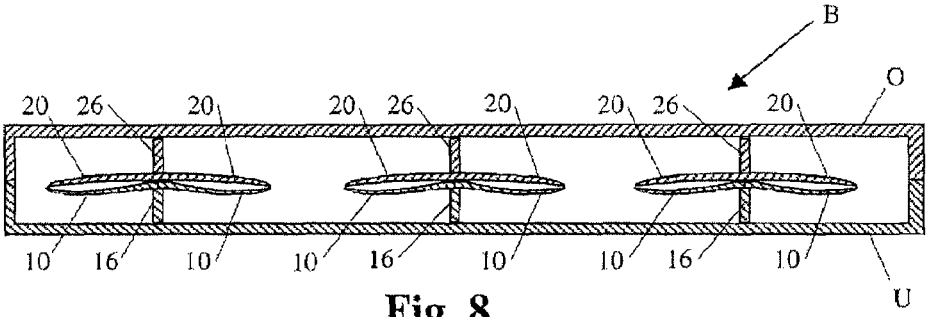
Fig. 8

DEVICE FOR RECEIVING A COMMODITY IN A FIXED POSITION

This is a National Phase Application in the United States of International Patent Application No. PCT/CH03/00128 filed Feb. 20, 2003, which claims priority on Swiss Patent Application No. 2002 0570/02, filed Apr. 4, 2002. The entire disclosures of the above patent applications are hereby incorporated by reference.

The invention relates to a device for receiving a commodity, in particular a wristwatch or writing implement, in a fixed position in accordance with the preamble of the independent claim.

Many commodities such as wristwatches or writing implements, for example, are frequently presented for sale in transparent plastic containers (cases). Fastening elements are generally provided in the container in this case in order to fix the commodity in its position and thus also protect it from damage, in particular during transport. Moulded inserts, plastic holders, rubber holders, microcellular rubber holders and flexible pressure holders (clips) are mostly used as fastening elements.

The fastening elements known hitherto are either structurally relatively expensive or must be matched to the shape and dimensions of the commodity or hinder a free view onto the commodity (specially in the case of the known pressure holders). Moreover, with some known fastening elements the fitting and removal of the commodity is relatively complicated and is associated with a relatively high risk of damage.

As a result of the present invention, these disadvantages are now to be removed and a device of the aforementioned type improved so that with a minimal structural expense the commodity can be perfectly fixed in position, i.e. substantially irrespective of its shape and dimensions. In other words, a universally usable device is to be provided, which may be produced with minimum structural expense, is suitable for receiving different commodities and perfectly and securely fixing these in position.

The solution to this problem forming the basis of the invention is evident from the features described in the characterising clause of the independent claim. Particularly advantageous configurations and further developments are the subject of the dependent claims.

Hence, according to the most general concept of the invention, the fastening elements are configured as a pair or pairs of clips, wherein one clip of each pair is respectively arranged in the upper portion and in the lower portion of the container. When the container is open, the commodity can be inserted into the lower portion of the container or removed from this without difficulty. When the container is closed, i.e. when the upper portion is placed on the lower portion, the two clips of the pair of clips clamp the commodity between them and thus fix them securely in position. In this case, commodities of different dimensions can be effectively fixed in position with the very same device as a result of the resilient configuration of the pairs of clips.

According to a particularly advantageous aspect of the invention, the holding elements or pairs of clips are configured as clasp springs, which extend from the side walls of the lower portion and upper portion of the container into the interior of the lower portion or upper portion respectively. This configuration is structurally particularly simple and, moreover, only requires a minimal covering of the commodity to be fixed in position. If according to a further advantageous embodiment the holding elements are made from a transparent material, the view onto the commodity is virtually not hindered at all.

The invention is explained in more detail below on the basis of the drawing, wherein:

FIG. 1 is a schematic inclined view of a first embodiment of the device according to the invention in open state and with an inserted wristwatch as commodity;

FIG. 2 is a sectional view along line II-II through the device according to FIG. 1 in closed state and without any commodity inserted;

FIG. 3 is a sectional view similar to FIG. 2 through another embodiment of the device according to the invention;

FIG. 4 is a sectional view similar to FIG. 2 through a detail variation;

FIG. 5 is a sectional view similar to FIG. 2 through a further detail variation;

FIG. 6 is a top view onto a further detail variation;

FIG. 7 is a sectional view similar to FIG. 2 through a further detail variation, and FIG. 8 is a sectional view similar to FIG. 2 through a further embodiment of the device according to the invention.

The device shown in FIG. 1 has the parallelepipedal form of a classic case from the outside. It comprises a container given the overall reference B, which consists of a dish-shaped lower portion U and a dish-shaped upper portion or cover O. The lower portion U and upper portion O each include lateral walls 50 and a bottom wall 60, together defining a single useful volume V when the upper portion U is placed on top of the lower portion U. As shown and as known per se, the upper portion O can be hinged on the lower portion U and therefore be configured to fold open, but can also be configured so that it is completely removable from the lower portion. In addition, locking elements (not shown) are provided, which prevent the upper portion O being unintentionally detached from the lower portion U when the container B is in closed state. Such locking elements can be formed by locking bars or snap mechanisms, as known per se. The external shape of the container B is dependent on the commodity to be received and has no significance for the present invention.

Fastening elements are provided in the container B for a commodity to be received; a wristwatch A in the embodiment shown. In accordance with the most important concept of the invention, these fastening elements comprise resilient holding elements 10 and 20 interacting in pairs and respectively arranged both in the lower portion U and in the upper portion O of the container B. The two holding elements 10, 20 of each pair interact so that they resiliently clamp between them the commodity A located in the container when the upper portion O is placed on the lower portion U of the container B. The holding elements 10, 20 thus form resilient pairs of clips.

As may be seen in particular from FIG. 2, the holding elements 10 and 20 spring up and down. Up and down in this case refers to the usual position of the device in use when closed, wherein the lower portion U of the container B is at the bottom and the upper portion O is at the top.

It has been found that the fastening of the commodity achieved by the pairs of clips according to the invention respectively with two resilient holding elements is substantially better than with comparable conventional fastening elements.

The number of pairs of holding elements 10, 20 is dependent on the type of commodity to be fixed in place. Two pairs are generally sufficient in the case of a wristwatch or a writing implement (e.g. fountain pen or pencil). A single pair may also be sufficient in special cases.

In the embodiments shown in FIGS. 1, 2 and 4-7, the holding elements 10 and 20 are configured as clasp springs, which respectively extend inwards from the side walls of the lower portion U or the upper portion O of the container B. In this case, the clasp springs can be fastened on the same sides of the container or also on opposing sides. However, as shown in the embodiment of FIG. 8, the clasp springs can also be attached to the horizontal (in the usual position of use) inside walls of the lower portion U or upper portion O.

The clasp springs 10, 20 are preferably curved, as shown, wherein the clasp springs or holding elements 10 in the lower portion U are concave leaf type shaped elements as viewed from the open side of the lower portion, so that they form a kind of depression for the commodity to be received. The clasp springs or holding elements 20 in the upper portion O are curved in a mirror-inverted manner, i.e. are convex leaf type shaped elements as viewed from the open side of the lower portion. Depending on the external shape of the commodity to be held in place, however, the clasp springs may also be plane or curved in the other direction. Equally, any desired combinations of curved and plane clasp springs are also possible.

As shown in FIG. 4, the holding elements 10 and 20 can also consist of two respective holding element sections 11 and 12, which are attached on opposite sides of the lower portion 10 or upper portion 20 and also extend inwards from there.

According to FIG. 6, the holding elements 10, 20 can also be specially configured with two or multiple fingers (in a comb-like manner). With commodities of complex structures, this allows better adaptation to their external shape and thus provides a better fastening effect.

To enhance the fastening effect, the holding elements 10, 20 can additionally have friction-increasing means in particular on their sides facing one another. Such friction-increasing means can be formed, for example, by structures 13 such as ribs and similar (FIG. 7) or by friction-increasing layers 14, e.g. a foam rubber coating (FIG. 5).

As FIG. 2 further shows, the holding elements 10 and 20 configured as clasp springs can also be bent so that they form a receiving area 15 for the commodity between them. Naturally, this receiving area 15 must have a smaller clearance height than the dimension of the commodity to be received at this location, since otherwise no clamping effect results. However, as a result of the bending of the two holding elements 10 and 20, lateral stops are formed for the commodity, which further improve fixture. Naturally, this can also be achieved by other suitable structures on the holding elements 10 and 20.

FIG. 3 shows a further embodiment of the device according to the invention, in which the holding elements are not configured as clasp springs, but as flexible caps 30 and 40, which respectively interact in pairs and when the container B is in closed state, elastically clamp the commodity located therein between them. One cap 30 is attached to the base of the lower portion U therein and extends upwards from this. The other cap 40 is attached to the inner upper wall (base of the cover) of the upper portion O and extends downwards from this. The caps 30 and 40 can be hollow (by example cap 40) or solid (by example cap 30). In both cases, the caps are made of a suitably soft and elastically flexible material.

FIG. 8 shows a further embodiment of the device according to the invention. In this embodiment, the container B is configured to receive six commodities adjacent to one another. For this, six pairs of holding elements 10, 20 are arranged in twos, wherein two adjacent holding elements 10 or 20 in each case respectively extend from a joint support 16 or 26, which is attached to the inner upper wall (base of the cover) of the upper portion O or on the base of the lower portion U. Naturally, the device according to the invention or the container B can also contain a smaller or larger number of holding element pairs 10, 20. Moreover, not all holding element pairs 10, 20 must have the same form.

The holding elements 10, 20 as well as 30, 40 can be produced as elements that are independent of the container B and can be inserted into the lower portion U or upper portion O of the container B and suitably fastened there. In this case, they can also be composed of a different material (e.g. thermoplastic polymers) from the container B (polypropylene). However, the holding elements are preferably composed of the same material (e.g. polypropylene) as the lower portion U or the upper portion O of the container B and formed in one piece with the lower portion U or the upper portion O. This allows a particularly simple and inexpensive production of the device according to the invention, e.g. by injection moulding. If the upper portion O of the container B is transparent, preferably at least the holding elements 20 and 40 in the upper portion O are also transparent so as to hinder as little as possible the view onto the commodity located in the container B.

The invention claimed is:

1. A device adapted to receive an elongated shaped commodity having a planar dimension and an edge, in particular, a wristwatch, in a fixed position, wherein the device comprises:

(a) a container comprising a dish-shaped lower portion and a dish-shaped upper portion, wherein the lower portion and upper portion each include lateral walls and a bottom wall, together defining a single useful volume when the upper portion is placed on top of the lower portion; and (b) at least one fastening element provided in the container for receiving the commodity, wherein the at least one fastening element is configured as a pair of clips and comprises i. a resilient lower holding element arranged in the lower portion of the container, wherein the lateral walls include a first lateral wall of the lower portion, and said resilient lower holding element extends from said first lateral wall of the lower portion towards said useful volume of the container; and ii. a resilient upper holding element arranged in the upper portion of the container, wherein the lateral walls include a first lateral wall of the upper portion, and said resilient upper holding element extends from said first lateral wall of the upper portion towards said useful volume of the container, wherein the dish-shaped lower portion and the dish-shaped upper portion can be placed in a first position and in a second position, wherein in the first position said holding elements together form the pair of clips and interact so that the pair of clips resiliently clamp the commodity located in the container by the planar dimension, and said upper portion is placed on the lower portion of the container, and in the second position said holding elements do not interact to clamp the commodity between said holding elements, wherein the lower holding element is arranged in the lower portion of the container and is configured as a concave leaf type shaped element when viewed from an open side of the lower portion when said device is in the second position, and wherein the upper holding element is arranged in the upper portion of the container and is configured as a convex leaf type shaped element when viewed from the open side of the upper portion when said device is in the second position.

2. The device according to claim 1, wherein the holding elements are configured as clasp springs.

3. The device according to claim 1, wherein the holding elements have friction-increasing means on sides facing one another.

4. The device according to claim 1, wherein the holding elements are essentially transparent.

5. A device adapted to receive an elongated shaped commodity having a planar dimension and an edge, the device comprising:

a container comprising a dish-shaped lower portion and a dish-shaped upper portion wherein the lower portion and upper portion each include lateral walls and a bottom wall, together defining a single useful volume when the upper portion is placed on top of the lower portion; and at least one fastening element provided in the container, wherein the at least one fastening element is configured as a pair of clips comprising a resilient lower holding element arranged in the lower portion and a resilient upper holding element arranged in the upper portion, wherein the dish shaped lower portion and the dish shaped upper portion are positionable in a first position so that the resilient upper holding element and the resilient lower holding element together form the pair of clips and interact to resiliently clamp the commodity by the planar dimension therebetween when the upper portion is placed on the lower portion of the container, wherein the dish shaped lower portion and the dish shaped upper portion are positionable in a second position wherein the resilient upper holding element and the resilient lower holding element do not interact to clamp the commodity therebetween, wherein the lower holding element is arranged in the lower portion of the container, and the lateral walls include a first lateral wall of the lower portion, and the lower holding element extends from said first lateral wall of the lower portion towards said useful volume of the container and is configured as a curved leaf type shaped element having a curved leaf type shaped profile when viewed from an open side of the lower portion when the upper portion and the lower portion are in said second position, and wherein the upper holding element is arranged in the upper portion of the container, and the lateral walls include a first lateral wall of the upper portion, and the upper holding element extends from said first lateral wall of the upper portion towards said useful volume of the container and is configured as a curved leaf type shaped element having a curved leaf type shape profile when viewed from an open side of the upper portion when said upper dish-shaped portion is in said second position.

6. The device according to claim 5, wherein the lower holding element comprises a cantilever.

7. The device according to claim 5, wherein the upper holding element comprises a cantilever.

8. The device according to claim 7, wherein the lower holding element comprises a cantilever.

9. A device adapted to receive an elongated shaped commodity having a planar dimension and an edge, the device comprising:

(a) a lower portion;

(b) an upper portion, wherein the lower portion and upper portion each include lateral walls and a bottom wall, together defining a single useful volume when the upper portion is placed on top of the lower portion; and (c) a fastening element, wherein the fastening element comprises i. a resilient lower holding element in the lower portion, wherein the lateral walls include a first lateral wall of the lower portion, and said resilient lower holding element extends from said first lateral wall of the lower portion towards said useful volume of the container; and ii. a resilient upper holding element in the upper portion, wherein the lateral walls include a first lateral wall of the upper portion, and said resilient upper holding element extends from said first lateral wall of the upper portion towards said useful volume of the container, wherein the lower portion and the upper portion can be placed in a first position wherein the upper portion is placed on the lower portion so that the resilient lower holding element and the resilient upper holding element cooperate to form a pair of clips capable of resiliently clamping the commodity by the planar dimension between said holding elements located in the container, wherein the lower portion and the upper portion can be placed in a second position wherein said holding elements do not interact to clamp the commodity between said holding elements, and wherein the resilience of the pair of clips comes substantially from a restitution force created by a bending, rather than tension or compression, of at least one of the holding elements.

10. The device according to claim 9, wherein, in the first position, a portion of said resilient upper holding element contacts a portion of said resilient lower holding element.

11. A device adapted to receive an elongated shaped commodity, the device comprising:

(a) a lower portion;

(b) an upper portion; and (c) a fastening element, wherein the fastening element comprises i. a resilient lower holding element in the lower portion, wherein said resilient lower holding element extends from an interior wall of the lower portion towards an inside of the container; and ii. a resilient upper holding element in the upper portion, wherein said resilient upper holding element extends from an interior wall of the upper portion towards the inside of the container;

wherein the lower portion and the upper portion can be placed in a first position wherein the upper portion is placed on the lower portion so that the resilient lower holding element and the resilient upper holding element cooperate to form a pair of clips capable of resiliently clamping the commodity between said holding elements located in the container and a portion of said resilient upper holding element contacts a portion of said resilient lower holding element;

wherein the lower portion and the upper portion can be placed in a second position wherein said holding elements do not interact to clamp the commodity between said holding elements; and wherein the resilience of the pair of clips comes substantially from a restitution force created by a bending, rather than tension or compression, of at least one of the holding elements.

12. The device according to claim 11, wherein the holding elements are configured as clasp springs.

13. The device according to claim 11, wherein the holding elements have friction-increasing means on sides facing one another.

14. The device according to claim 11, wherein the holding elements are essentially transparent.

15. The device according to claim 11, wherein the lower holding element comprises a cantilever.

16. The device according to claim 11, wherein the upper holding element comprises a cantilever.

17. The device according to claim 11, wherein the elongated shaped commodity is selected from the group consisting of a wristwatch, a pen, and a pencil.

* * * * *